US010655252B2

(12) United States Patent
Debaes et al.

(10) Patent No.: US 10,655,252 B2
(45) Date of Patent: May 19, 2020

(54) FABRIC AND METHOD OF WEAVING A FABRIC, IN PARTICULAR A CARPET

(71) Applicant: Vandewiele NV, Kortrijk/Marke (BE)

(72) Inventors: Steven Debaes, Rekkem (BE); Dominique Maes, Dentergem (BE); Bram Vanderjeugt, Leper (BE)

(73) Assignee: Vandewiele NV, Kortrijk/Marke (BE)

( * ) Notice: Subject to any disclaimer, the term of this patent is extended or adjusted under 35 U.S.C. 154(b) by 161 days.

(21) Appl. No.: 15/848,019

(22) Filed: Dec. 20, 2017

(65) Prior Publication Data

US 2018/0171517 A1 Jun. 21, 2018

(30) Foreign Application Priority Data

Dec. 21, 2016 (EP) ..... 16205656

(51) Int. Cl.
*D03D 27/16* (2006.01)
*D03D 27/10* (2006.01)
*D03D 27/06* (2006.01)

(52) U.S. Cl.
CPC ..... *D03D 27/16* (2013.01); *D03D 27/06* (2013.01); *D03D 27/10* (2013.01); *D03D 2700/60* (2013.01); *D10B 2503/04* (2013.01)

(58) Field of Classification Search
CPC .. D03D 1/00; D03D 1/0017; D03D 27/00–16; D03D 39/00; D03D 39/02;
(Continued)

(56) References Cited

U.S. PATENT DOCUMENTS

2002/0189702 A1* 12/2002 Smissaert ..... D03D 27/10 139/418
2007/0006932 A1* 1/2007 Mertens ..... D03D 27/10 139/37
(Continued)

FOREIGN PATENT DOCUMENTS

EP 1217114 A1 * 6/2002 ..... D03D 27/10
EP 3192909 A1 * 7/2017 ..... D03D 27/10
(Continued)

OTHER PUBLICATIONS

European Search Report filed in EP 16 20 5656 dated Jun. 12, 2017.

*Primary Examiner* — Clinton T Ostrup
*Assistant Examiner* — Andrew Wayne Sutton
(74) *Attorney, Agent, or Firm* — Rankin, Hill & Clark LLP

(57) ABSTRACT

A fabric includes a backing fabric having binding warp yarns, weft yarns, and pile warp yarns interlaced with the weft yarns. In a weft receiving opening, one of the weft yarns is positioned at a back side relative to a weft separating warp yarn extending in the backing fabric in the warp direction and the other weft yarn is positioned at the pile side. A pile warp yarn is interlaced with the weft yarn positioned at the back side relative to the weft separating warp yarn to extend out of the backing fabric between this weft yarn and the other weft yarn. In a transition zone, two transition weft yarns provided immediately adjacent to each other in the warp direction extending through a weft receiving opening are positioned at substantially the same level in a direction that is perpendicular with a plane defined by the warp and weft directions and/or are not separated by a weft separating warp yarn.

22 Claims, 5 Drawing Sheets

(58) Field of Classification Search
CPC ..... D03D 39/04; D03D 39/08; D03D 39/10; D03D 39/12; D03D 39/16; D03D 39/18; D03D 39/20; D03D 39/22; D03D 2700/50–60
See application file for complete search history.

(56) References Cited

U.S. PATENT DOCUMENTS

| | | | | |
|---|---|---|---|---|
| 2007/0102056 | A1* | 5/2007 | Debaes ..... | D03D 27/00 139/21 |
| 2008/0053557 | A1* | 3/2008 | Debaes ..... | D03D 27/06 139/404 |
| 2018/0171517 | A1* | 6/2018 | Debaes ..... | D03D 27/06 |

FOREIGN PATENT DOCUMENTS

| | | | | |
|---|---|---|---|---|
| GB | 191206384 | | 5/1912 | |
| WO | 2013/041938 | | 3/2013 | |
| WO | WO-2013041938 | A2 * | 3/2013 | ..... D03D 27/10 |
| WO | WO-2013093611 | A2 * | 6/2013 | ..... D03D 27/06 |
| WO | WO-2017122164 | A1 * | 7/2017 | ..... D03D 15/04 |

* cited by examiner

TC
BC
PY1
TE1
Z
TE2
BS
T
BF
O
PY2
O
Z
O
T

TC
BC
TE1
PY3
TE2
T
BF
O
Z
O
TE1
Z
TE2
O

TC
BC
PY1
TE1
Z
TE2
T
PY3
O
T
O
Z
O

FABRIC AND METHOD OF WEAVING A FABRIC, IN PARTICULAR A CARPET

The present invention relates to a fabric and a method of weaving a fabric, in particular a carpet, having inclined piles for providing a shadow effect.

Such a fabric is known from WO2013/041938 A. For changing the direction of inclination of the piles, a transition zone is provided extending over five immediately adjacent weft yarns in a particular fabric.

It is the object of the present invention to provide a fabric and a method of weaving a fabric, in particular a carpet, having inclined piles, with which a transition zone extending over a reduced number of weft threads can be obtained.

According to a first aspect of the invention, this object is achieved by a fabric, in particular a carpet, having a shadow effect, comprising

- a backing fabric having binding warp yarns repeatedly crossing each other for providing weft receiving openings between crossings thereof following each other in a warp direction and weft yarns substantially extending in a weft direction through the weft receiving openings,
- pile warp yarns interlaced with weft yarns of the backing fabric for providing piles extending out of the backing fabric at a pile side, wherein, through at least one weft receiving opening, preferably the majority of the weft receiving openings, most preferably each weft receiving opening, two weft yarns extend, wherein in at least one weft receiving opening, preferably the majority of the weft receiving openings, one of the weft yarns is positioned at a back side relative to at least one weft separating warp yarn extending in the backing fabric substantially in the warp direction and the other one of the weft yarns is positioned at the pile side relative to the at least one weft separating warp yarn, wherein, for providing a pile in association with this weft receiving opening, a pile warp yarn is interlaced with the weft yarn of this weft receiving opening positioned at the back side relative to the at least one weft separating warp yarn, such as to extend out of the backing fabric between this weft yarn and the other weft yarn of this weft receiving opening, wherein, for changing the direction of inclination of the piles, at least one transition zone is provided, wherein, in at least one transition zone, two transition weft yarns provided immediately adjacent to each other in the warp direction extending through at least one weft receiving opening are positioned at substantially the same level in a direction that is substantially perpendicular with respect to a plane defined by the warp direction and the weft direction and/or are not separated by a weft separating warp yarn.

In the fabric of the present invention, changing the direction of inclination of piles needs only two transition weft yarns of a transition zone, which leads to a substantially enhanced optical appearance of such a fabric.

For providing a uniform interaction of the transition weft yarns with the pile warp yarns, in at least one transition zone, the two transition weft yarns may be positioned at a back side relative to at least one weft separating warp yarn, and/or in at least one transition zone, the two transition weft yarns may be positioned at a pile side relative to at least one weft separating warp yarn.

In at least one transition zone, the two transition weft yarns may extend through the same weft receiving opening, and/or in at least one transition zone, the two transition weft yarns may extend through different weft receiving openings.

For changing the direction of inclination of the piles and changing the pile-forming pile warp yarn, in at least one transition zone, a first one of the transition weft yarn may be interlaced with a first pile-forming pile warp yarn and a second one of the transition weft yarns may be interlaced with a second pile-forming pile warp yarn, such that a pile provided by the first pile-forming pile warp yarn extends out of the backing fabric at the pile side between the first one of the transition weft yarns and a weft yarn immediately adjacent to the first one of the transition weft yarns in a first orientation of the warp direction, and a pile provided by the second pile-forming pile warp yarn extends out of the backing fabric at the pile side between the second one of the transition weft yarns and a weft yarn immediately adjacent to the second one of the transition weft yarns in a second orientation of the warp direction.

For changing the direction of inclination of the piles and changing the pile forming pile warp yarn, in at least one transition zone, a pile-forming pile warp yarn may be interlaced with one of the two transition weft yarns of this transition zone, such that a pile provided by the pile-forming pile warp yarn extends out of the backing fabric at the pile side between the two transition weft yarns of this transition zone and that no pile extends out of the backing fabric between the other one of the two transition weft yarns of this transition zone and a weft yarn immediately adjacent to this transition weft yarn or that no pile extends out of the backing fabric between the one of the two transition weft yarns of this transition zone and a weft yarn immediately adjacent to this transition weft yarn.

For changing the inclination of the piles without changing the pile forming pile warp yarn, in at least one transition zone, the pile-forming pile warp yarn may be interlaced with none of the two transition weft yarns of this transition zone, such that a first pile provided by the pile-forming pile warp yarn extends out of the backing fabric at the pile side between a first one of the transition weft yarns and a weft yarn immediately adjacent to the first one of the transition weft yarns of this transition zone in a first orientation of the warp direction, and a second pile provided by the pile-forming pile warp yarn extends out of the backing fabric at the pile side between a second one of the transition weft yarns of this transition zone and a weft yarn immediately adjacent to the second one of the transition weft yarns in a second orientation of the warp direction.

Further, for changing the inclination of the piles without changing the pile forming pile warp yarn, in at least one transition zone, the pile-forming pile warp yarn may be interlaced with one of the two transition weft yarns extending through a weft receiving opening of this transition zone, such as to extend out of the backing fabric at the pile side between the two transition weft yarns of this weft receiving opening.

In an alternative arrangement, for changing the inclination of the piles without changing the pile-forming pile warp yarn, in at least one transition zone, the pile-forming pile warp yarn, in a first weft receiving opening of this transition zone, may be interlaced with a weft yarn separated from the transition weft yarn of this first weft receiving opening by at least one weft separating warp yarn, such that a first pile provided by this pile-forming pile warp yarn extends out of the backing fabric at the pile side between the transition weft yarn of this first weft receiving opening and the other weft yarn of this first weft receiving opening, and, in a second weft receiving opening of this transition zone, is interlaced with a weft yarn separated from the transition weft yarn of this second weft receiving opening by at least one weft separating warp yarn, such that a second pile provided by this pile-forming pile warp yarn extends out of the backing fabric at the pile side between the transition weft yarn of this second weft receiving opening and the other weft yarn of this second weft receiving opening.

For only using a reduced number of warp yarns, no tension warp yarns may be provided in the backing fabric.

For providing the inclined piles, in association with at least one weft receiving opening, a pile may be provided by interlacing a pile warp yarn with a weft yarn of this weft receiving opening positioned immediately adjacent in a first orientation of the warp direction to the crossing of the binding warp yarns defining this weft receiving opening and in association with at least one other weft receiving opening a pile may be provided by interlacing a pile warp yarn with a weft yarn of this weft receiving opening positioned immediately adjacent in a second orientation of the warp direction to the crossing of the binding warp yarns defining this weft receiving opening.

For providing a clear separation of weft yarns within the weft receiving openings, pile warp yarns not used for forming piles may be bound into the backing fabric such as to extend substantially in the warp direction as dead pile warp yarns, and the weft yarns of at least one weft receiving opening may be separated from one another by at least one, preferably all the dead pile warp yarns extending in the area of this weft receiving opening as weft separating warp yarns.

A plurality of warp yarn systems may be provided following each other in the weft direction, at least one warp yarn system, preferably the majority of warp yarn systems, most preferably each warp yarn system, comprising two binding warp yarns crossing each other and at least one, preferably a plurality of pile warp yarns. In the pile warp yarn systems, piles may be provided by the pile warp yarns of a respective pile warp yarn system by interlacing these pile warp yarns with weft yarns extending through the weft receiving openings provided by the binding warp yarns of the same pile warp yarn system, preferably such that, by means of the pile warp yarns of each one of the warp yarn systems, one row of piles substantially extending in the warp direction is provided.

According to a further aspect, the above object is achieved by a method of weaving a fabric, in particular a carpet, having a shadow effect, wherein, for providing a backing fabric:

binding warp yarns are provided repeatedly crossing each other for providing weft receiving openings between crossings thereof following each other in a warp direction, weft yarns are provided such as to extend through the weft receiving openings substantially in a weft direction, wherein, for providing piles extending out of the backing fabric at a pile side, pile warp yarns are interlaced with weft yarns of the backing fabric, wherein the weft yarns are provided such that, through at least one weft receiving opening, preferably the majority of the weft receiving openings, most preferably each weft receiving opening, two weft yarns extend, wherein, in at least one weft receiving opening, preferably the majority of the weft receiving openings, one of the weft yarns is positioned at a back side relative to at least one weft separating warp yarn extending in the backing fabric substantially in the warp direction and the other one of the weft yarns is positioned at the pile side relative to the at least one weft separating warp yarn, wherein, for providing a pile in association with this weft receiving opening, a pile warp yarn is interlaced with the weft yarn of this weft receiving opening positioned at the back side relative to the at least one weft separating warp yarn, such as to extend out of the backing fabric between this weft yarn and the other weft yarn of this weft receiving opening, wherein, for changing the direction of inclination of the piles, at least one transition zone is provided, wherein, in at least one transition zone, two transition weft yarns provided immediately adjacent to each other in the warp direction are provided such as to be positioned at substantially the same level in a direction that is substantially perpendicular with respect to a plane defined by the warp direction and the weft direction and/or are provided such as not to be separated by a weft separating warp yarn.

In at least one transition zone, the two transition weft yarns may be positioned at a back side relative to at least one weft separating warp yarn, and/or in at least one transition zone, the two transition weft yarns may be positioned at a pile side relative to at least one weft separating warp yarn.

Further, in at least one transition zone, the two transition weft yarns may be provided such as to extend through the same weft receiving opening, and/or in at least one transition zone, the two transition weft yarns may be provided such as to extend through different weft receiving openings.

For changing the direction of inclination of the piles and changing the pile forming pile warp yarn, in at least one transition zone, a first one of the transition weft yarns may be interlaced with a first pile-forming pile warp yarn and a second one of the transition weft yarns may be interlaced with a second pile-forming pile warp yarn, such that a pile provided by the first pile-forming pile warp yarn extends out of the backing fabric at the pile side between the first one of the transition weft yarns and a weft yarn immediately adjacent to the first one of the transition weft yarns in a first orientation of the warp direction, and a pile provided by the second pile-forming pile warp yarn extends out of the backing fabric at the pile side between the second one of the transition weft yarns and a weft yarn immediately adjacent to the second one of the transition weft yarns in a second orientation of the warp direction.

For changing the direction of inclination of the piles and changing the pile forming pile warp yarn, in at least one transition zone, a pile-forming pile warp yarn may be interlaced with one of the two transition weft yarns of this transition zone, such that a pile provided by the pile-forming pile warp yarn extends out of the backing fabric at the pile side between the two transition weft yarns of this transition zone and that no pile extends out of the backing fabric between the other one of the two transition weft yarns of this transition zone and a weft yarn immediately adjacent to this transition weft yarn or that no pile extends out of the backing fabric between the one of the two transition weft yarns of this transition zone and a weft yarn immediately adjacent to this transition weft yarn.

For changing the inclination of the piles without changing the pile-forming pile warp yarn, in at least one transition zone, the pile-forming pile warp yarn may be interlaced with none of the two transition weft yarns of this transition zone, such that a first pile provided by the pile-forming pile warp yarn extends out of the backing fabric at the pile side between a first one of the transition weft yarns and a weft yarn immediately adjacent to the first one of the transition weft yarns of this transition zone in a first orientation of the warp direction, and a second pile provided by the pile-forming pile warp yarn extends out of the backing fabric at the pile side between a second one of the transition weft yarns of this transition zone and a weft yarn immediately adjacent to the second one of the transition weft yarns in a second orientation of the warp direction.

Further, for changing the inclination of the piles without changing the pile-forming pile warp yarn, in at least one transition zone, the pile-forming pile warp yarn may be interlaced with one of the two transition weft yarns extending through a weft receiving opening of this transition zone, such as to extend out of the backing fabric at the pile side between the two transition weft yarns of this weft receiving opening.

According to an alternative method, for changing the inclination of the piles without changing the pile-forming pile warp yarn, in at least one transition zone, the pile-forming pile warp yarn, in a first weft receiving opening of this transition zone, may be provided such as to be interlaced with a weft yarn separated from the transition weft yarn of this first weft receiving opening by at least one weft separating warp yarn, such that a first pile provided by this pile-forming pile warp yarn extends out of the backing fabric at the pile side between the transition weft yarn of this first weft receiving opening and the other weft yarn of this first weft receiving opening, and, in a second weft receiving opening of this transition zone, is provided such as to be interlaced with a weft yarn separated from the transition weft yarn of this second weft receiving opening by at least one weft separating warp yarn, such that a second pile provided by this pile-forming pile warp yarn extends out of the backing fabric at the pile side between the transition weft yarn of this second weft receiving opening and the other weft yarn of this second weft receiving opening.

In association with each fabric to be woven, a plurality of warp yarn systems may be provided following each other in the weft direction, at least one warp yarn system, preferably the majority of warp yarn systems, most preferably each warp yarn system, comprising two binding warp yarns crossing each other and at least one, preferably a plurality of pile warp yarns, wherein, in the pile warp yarn systems, piles are provided by the pile warp yarns of a respective pile warp yarn system by interlacing these pile warp yarns with weft yarns extending through the weft receiving openings provided by the binding warp yarns of the same pile warp yarn system, preferably such that, by means of the pile warp yarns of each one of the warp yarn systems, one row of piles substantially extending in the warp direction is provided.

Further, in association with at least one, preferably each reed dent of a weaving machine, at least one warp yarn system may be provided, and/or in association with at least one warp yarn system, preferably the majority of warp yarn systems, most preferably each warp yarn system, no tension warp yarns may be provided.

For an increased output, the method may be a face-to-face weaving method for simultaneously weaving two fabrics, preferably wherein at least one, preferably each warp yarn system may comprise the warp yarns for both fabrics to be woven.

In association with at least one warp yarn system, the crossings of the binding warp yarns of one of the two fabrics to be woven may be offset relative to the crossings of the binding warp yarns of the other one of the fabrics to be woven in the warp direction.

Further, in at least one fabric, the crossings of the binding warp yarns defining the weft receiving openings in the two orientations of the warp direction may be located at the same position in the warp direction.

The invention will now be explained with reference to the drawings, in which.

Figure 1:
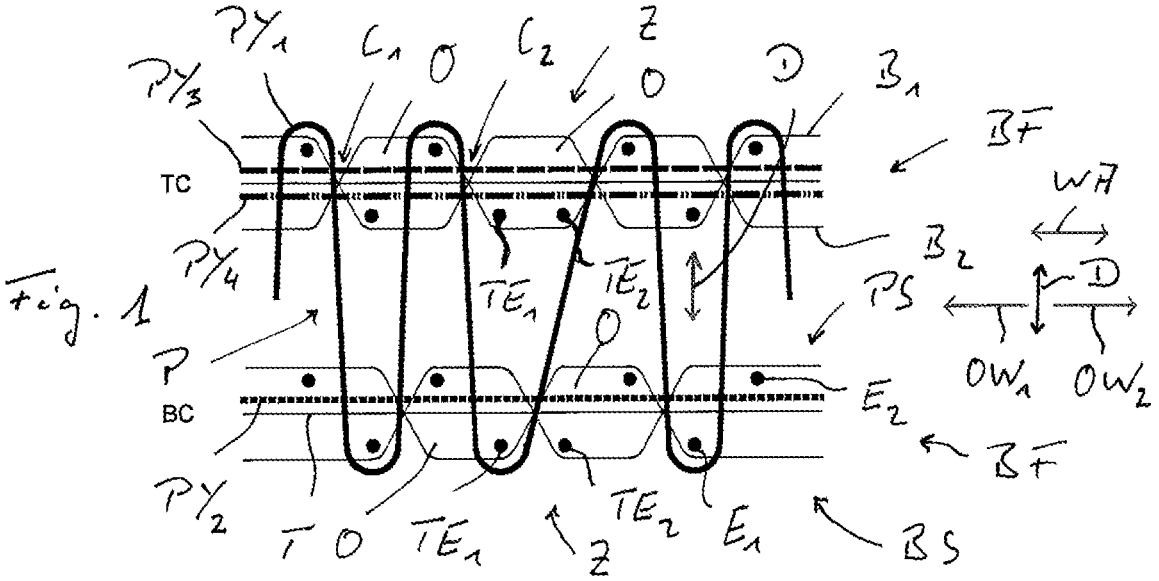
FIG. 1 shows a weaving structure of two fabrics in a face-to-face weaving process.

FIG. 1 shows the weaving structure of two fabrics TC and BC woven in a face-to-face weaving process. Each one of the two fabrics TC, BC comprises a backing fabric BF. Each backing fabric BF, preferably in association with each warp yarn system, comprises two binding warp yarns $B_1$, $B_2$ repeatedly crossing each other at crossings $C_1$, $C_2$ for providing weft-receiving openings O between each pair of crossings $C_1$, $C_2$. Two weft yarns $E_1$, $E_2$ extend through preferably each one of the weft receiving openings. Further, each backing fabric BF comprises tension warp yarns T extending in a warp direction WA such that, in most of the weft receiving openings O, one of the weft yarns $E_1$, $E_2$ is positioned at a pile side PS relative to the tension warp yarns T and one of the weft yarns $E_1$, $E_2$ is positioned at a back side BS relative to the tension warp yarns T.

It is to be noted that, in FIG. 1 as well as in all the other figures, warp yarns are shown which may be used for providing one warp yarn system. The warp yarns of one such warp yarn system may be arranged such as to extend through one and the same reed dent of a weaving machine such that a plurality of such warp yarn systems are provided following each other in the weft direction.

The fabrics TC, BC further comprise a plurality of pile warp yarns $PY_1$, $PY_2$, $PY_3$, $PY_4$ used for forming piles P extending out of the backing fabrics BF at the pile side PS thereof. In the portion of the weaving structure shown in FIG. 1, pile warp yarn $PY_1$ is used for forming piles by interlacing with weft yarns $E_1$, $E_2$ of the backing fabrics BF and extending between the two fabrics TC, BC such as to connect these two fabrics TC, BC during the weaving process and before being cut. As can be seen in FIG. 1, pile warp yarn $PY_1$ is interlaced with the one of the two weft yarns $E_1$, $E_2$ of each of the weft receiving openings O positioned at the back side BS relative to tension warp yarn T. Therefore, pile warp yarn $PY_1$ provides piles P extending out of the backing fabrics BF of the two fabrics TC, BC at the pile sides PS thereof between the two weft yarns $E_1$, $E_2$ of weft receiving openings O, and further provides piles P extending out of the backing fabrics BF at the pile sides PS thereof between the one weft yarn $E_1$, $E_2$ used for interlacing with pile warp yarn $PY_1$ and a weft yarn of an immediately adjacent weft receiving opening O not used for interlacing with pile warp yarn $PY_1$.

Pile warp yarns $PY_2$, $PY_3$, $PY_4$ not used for forming piles in the portion of the weaving structure shown in FIG. 1 are bound into the two backing fabrics BF of fabrics TC, BC. It can be seen that pile warp yarn $PY_2$, which, in the portion shown in FIG. 1, is a dead pile warp yarn and is bound into backing fabric BF of bottom fabric BC, while pile warp yarns $PY_3$, $PY_4$ providing dead piles in the portion shown in FIG. 1 are bound into backing fabric BF of top fabric TC. Pile warp yarns $PY_2$, $PY_3$, $PY_4$ forming dead piles in the portion shown in FIG. 1 extend substantially parallel to tension warp yarns T provided in the backing fabrics BF of the two fabrics TC, BC at the same level in a direction extending from the back side BS to the pile side PS. Therefore, in the weaving structure shown in FIG. 1, tension warp yarns T and all the dead piles, i.e. pile warp yarns $PY_2$, $PY_3$, $PY_4$, provide weft separating warp yarns separating the weft yarns $E_1$, $E_2$ of most of the weft receiving openings O in a direction D perpendicular with respect to a plane defined by the warp direction WA and the weft direction which is a direction perpendicular to the drawing plane of FIG. 1 and perpendicular to warp direction WA.

Figure 13:
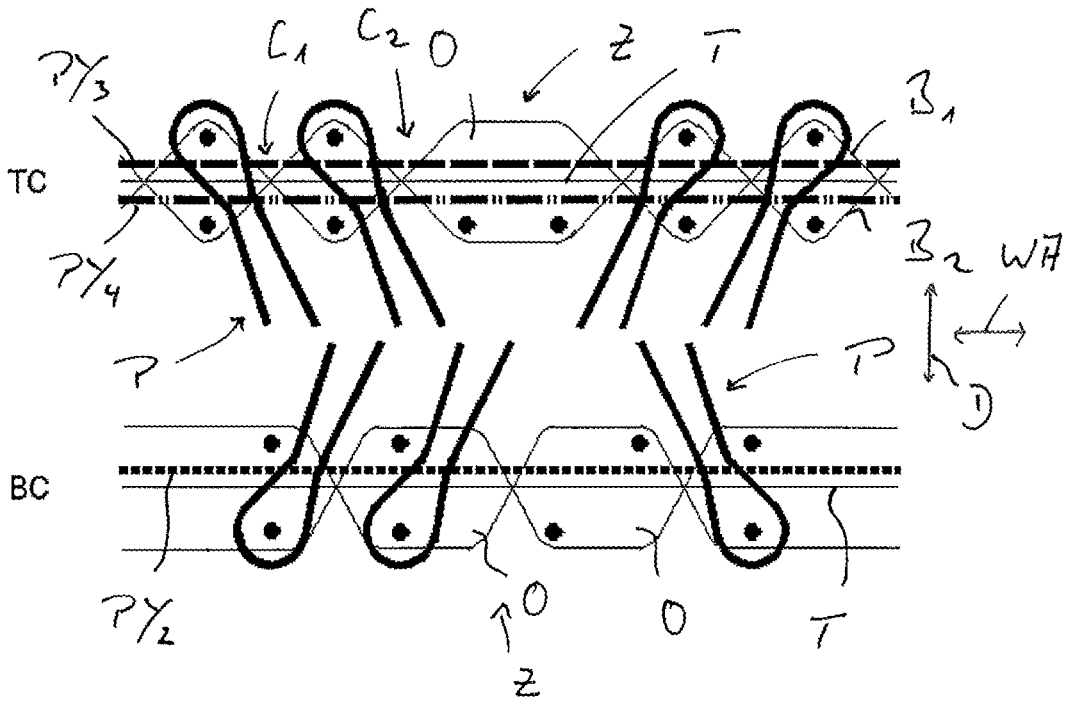
FIG. 13 shows the two fabrics having the weaving structure according to FIG. 1 after cutting the piles.

As can be seen in FIG. 13 showing the fabrics TC, BC having the weaving structure of FIG. 1 after cutting pile warp yarn $PY_1$ in the middle between the two fabrics TC, BC, due to this weaving structure, piles P will be inclined with respect to direction D perpendicular with respect to the plane defined by warp direction WA and the weft direction, and therefore will be inclined with respect to the surface of fabrics TC, BC. This inclined arrangement of piles P leads to a shadow effect in which, depending on the direction of inclination, the optical appearance of such a fabric, for example, a carpet, seems to be brighter in some areas and seems to be darker in other areas.

For adjusting and changing the direction of inclination of the piles P provided in the respective fabrics TC, BC, according to the present invention, there are provided transition zones Z. As can be seen in FIG. 1, transition zone Z provided in top fabric TC comprises two transition weft yarns $TE_1$, $TE_2$ extending through the same weft receiving opening O. Due to the offset in the warp direction WA of the crossings $C_1$, $C_2$ provided in the two fabrics TC, BC, a corresponding transition zone Z in bottom fabric BC comprises two transition weft yarns $TE_1$, $TE_2$ immediately adjacent to each other, but arranged in different weft receiving openings O. While, in the different fabrics TC, BC, the two transition weft yarns $TE_1$, $TE_2$ of the respective weft receiving zones are arranged in the same weft receiving opening or in different weft receiving openings, in each one of the transition zones Z associated with each other such that a change of inclination occurs in both of the fabrics TC, BC, the two transition weft yarns $TE_1$, $TE_2$ are positioned immediately adjacent to each other in the warp direction WA and are positioned on the same side relative to the tension warp yarns of the respective backing fabrics BF and the dead pile warp yarns $PY_2$, $PY_3$, $PY_4$ bound into the respective backing fabrics BF. This means that, in each transition zone Z, the two transition weft yarns $TE_1$, $TE_2$ are positioned at the same level in direction D perpendicular with respect to warp direction WA and the weft direction and are not separated by a weft separating warp yarn.

For generating a transition in the inclination of the piles P provided by pile warp yarn $PY_1$, none of the transition weft yarns $TE_1$, $TE_2$ of transition zone Z of the top fabric TC is used for interlacing with pile warp yarn $PY_1$. Instead, pile warp yarn $PY_1$ and the piles P provided by this pile warp yarn, respectively, extend out of backing fabric BF of top fabric TC between each one of the two transition weft yarns $TE_1$, $TE_2$ of this transition zone Z and the immediately adjacent weft yarns used for interlacing with pile warp yarn $PY_1$ at the back side BS with respect to weft separating warp yarns T, $PY_3$, $PY_4$ of top fabric TC.

In transition zone Z of the bottom fabric BC, one of the two transition weft yarns $TE_1$, $TE_2$, in particular transition weft yarn $TE_1$, is used for interlacing with pile warp yarn $PY_1$ such that a pile provided by pile warp yarn $PY_1$ extends out of backing fabric BF of bottom fabric BC between the two transition weft yarns $TE_1$, $TE_2$ of bottom fabric BC. Another pile provided by interlacing pile warp yarn $PY_1$ with transition weft yarn $TE_1$ in transition zone Z of bottom fabric BC extends out of backing fabric BF between this transition weft yarn $TE_1$ and a weft yarn extending through the same weft receiving opening and being positioned immediately adjacent to transition weft yarn $TE_1$ in a first orientation $OW_1$ of the warp direction WA.

FIG. 1 shows that, due to providing transition zones Z in both fabrics TC, BC, on the left side of transition zone Z, pile warp yarn $PY_1$ is interlaced with weft yarns extending through the weft receiving openings O positioned immediately adjacent to crossings $C_2$ defining these weft receiving openings O in the second orientation $OW_2$ of warp direction WA. On the right side of transition zones Z, pile warp yarn $PY_1$ is interlaced with weft yarns positioned immediately adjacent to crossings $C_1$ defining the respective weft receiving openings in the first orientation $OW_1$ of warp direction WA.

Figure 14:
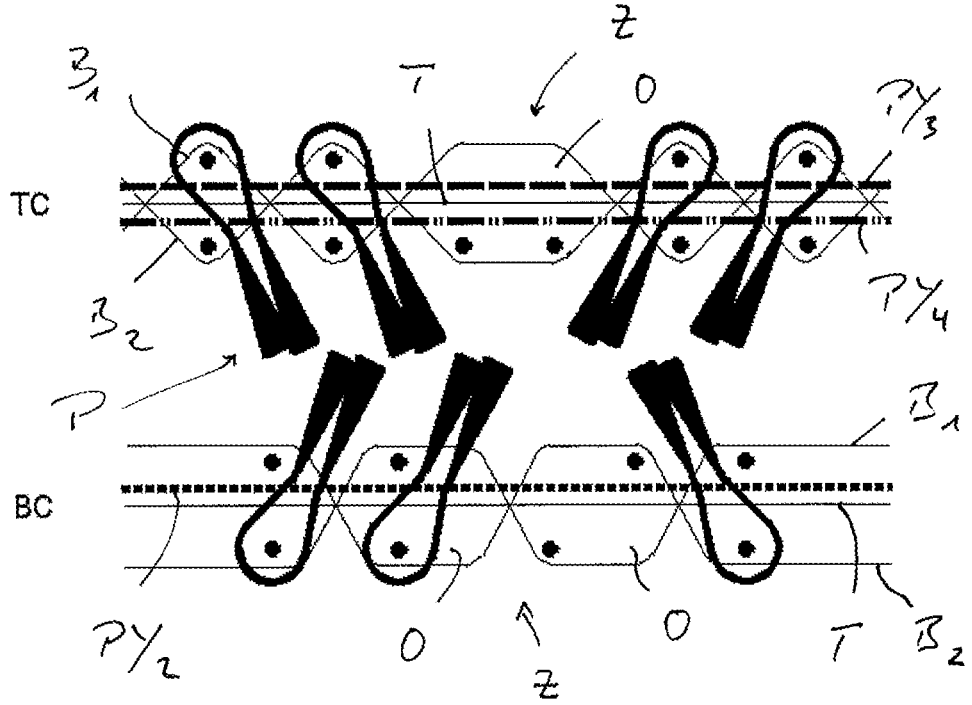
FIG. 14 shows the two fabrics having the weaving structure according to FIG. 1 after cutting the piles having piles showing a bulking effect.

After cutting pile warp yarn $PY_1$ in the middle between the two backing fabrics BF of fabrics TC, BC, piles P will become inclined in the manner shown in FIGS. 13 and 14. This effect is emphasized by a slight shift of the weft yarns extending through each of the weft receiving openings O towards each other due to a force applied by binding warp yarns $B_1$, $B_2$ in warp direction WA.

Figure 2:
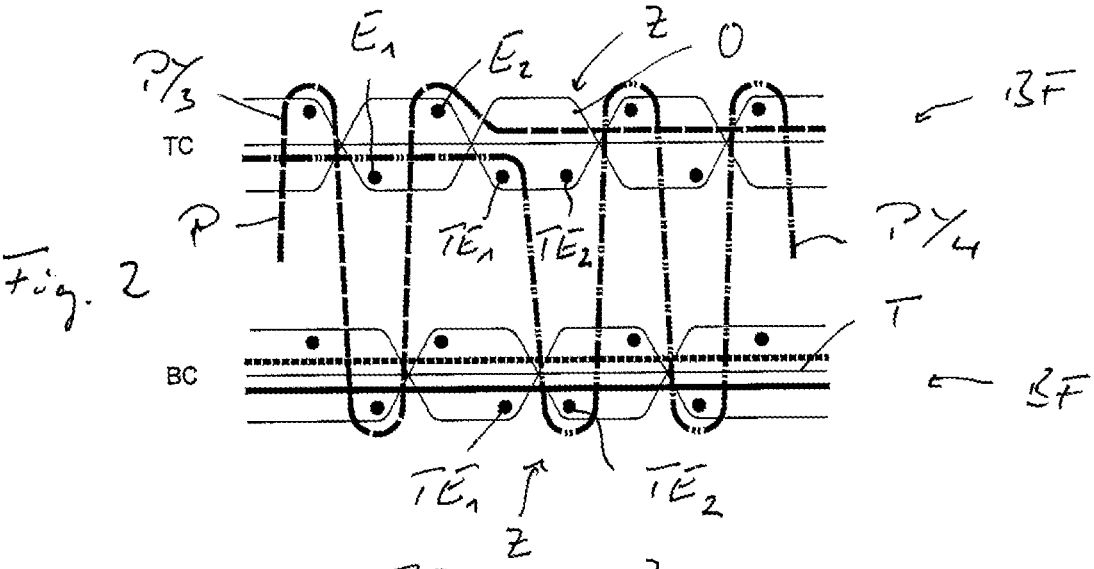
FIG. 2 shows an alternative weaving structure of two fabrics in a face-to-face weaving process.

An alternative way of changing the direction of inclination is shown in FIG. 2. While, in the weaving structure of FIG. 1, the direction of inclination is changed without changing the pile-forming pile warp yarn, in the structure shown in FIG. 2, the direction of inclination is changed accompanied by a change of the pile-forming pile warp yarn, both of the involved pile warp yarns being bound into the same fabric when providing a dead pile warp yarn.

The weaving structure of FIG. 2 again shows associated transition zones Z in the two fabrics TC, BC provided at the same location in the warp direction WA. The change of the pile-forming pile warp yarn occurs by interlacing pile warp yarn $PY_3$ used for forming piles on the left side of transition zones Z for the last time with weft yarn $E_2$ of weft receiving opening O immediately adjacent to transition zone Z of the top fabric TC and then binding in pile warp yarn $PY_3$ as a dead pile warp yarn into backing fabric BF of top fabric TC. Pile warp yarn $PY_4$ not used for forming piles on the left side of the transition zones Z is interlaced with transition weft yarn $TE_1$ of transition zone Z of top fabric TC such as to extend out of the backing fabric BF of top fabric TC between the two transition weft yarns $TE_1$, $TE_2$ of this transition zone Z. Pile warp yarn $PY_4$ extends towards the bottom fabric BC and is interlaced with transition weft yarn $TE_2$ of transition zone Z provided in bottom fabric BC. Therefore, in bottom fabric BC, a pile is provided such as to extend out of backing fabric BF between the two transition weft yarns $TE_1$, $TE_2$ of transition zone Z and a further pile is provided such as to extend out of backing fabric BF between transition weft yarn $TE_2$ of transition zone Z and an immediately adjacent weft yarn extending through the same weft receiving opening O as does transition weft yarn $TE_2$.

Figure 3:
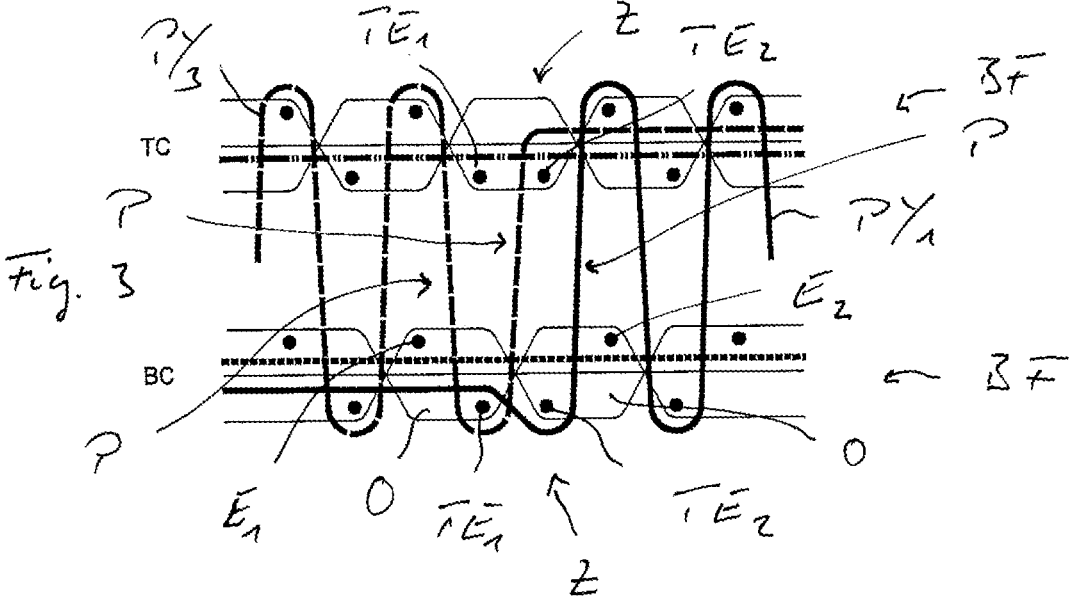
FIG. 3 shows a further alternative weaving structure of two fabrics in a face-to-face weaving process.

FIG. 3 shows a weaving structure in which, as is the case with the embodiment shown in FIG. 2, a change of inclination is accompanied by a change of the pile-forming pile warp yarn. While, in the embodiment shown in FIG. 2, the two pile-forming pile warp yarns used on both sides of the transition zones are bound into the same backing fabric when providing dead piles, in the embodiment shown in FIG. 3, pile warp yarns $PY_3$, $PY_1$ used for forming piles on both sides of transition zones Z are bound into the backing fabrics of different ones of the fabrics TC, BC when providing dead pile warp yarns. As can be seen in FIG. 3, pile warp yarn $PY_1$ is bound into backing fabric BF of bottom fabric BC when being a dead pile, while warp yarn $PY_3$ is bound into backing fabric BF of top fabric TC when providing a dead pile.

In the structure shown in FIG. 3, both transition weft yarns $TE_1$, $TE_2$ of transition zone Z of bottom fabric BC are used for interlacing with pile-forming pile warp yarns. While pile-forming pile warp yarn $PY_3$ used for forming piles on the left side of transition zone Z is interlaced with transition weft yarn $TE_1$ of transition zone Z of bottom fabric BC such as to extend out of backing fabric BF of bottom fabric BC towards the top fabric TC and to extend out of backing fabric BF of top fabric TC in transition zone Z thereof between the two transition weft yarns $TE_1$, $TE_2$ of this transition zone Z before being bound into backing fabric BF of top fabric TC on the right side of transition zones Z, pile warp yarn $PY_1$ bound into backing fabric BF of bottom fabric BC on the left side of transition zones Z, is interlaced with transition weft yarn $TE_2$ of this transition zone Z and extends out of backing fabric BF of bottom fabric BC between this transition weft yarn $TE_2$ and weft yarn $E_2$ extending through the same weft receiving opening O immediately adjacent to transition weft yarn $TE_1$ in the second orientation $OW_2$ of the warp direction WA. Therefore, by interlacing pile-forming pile warp yarns $PY_3$, $PY_1$ with the two transition weft yarns $TE_1$, $TE_2$ of transition zone Z of bottom fabric BC, three piles P of bottom fabric BC are provided. One of these piles P extends out of backing fabric BF of bottom fabric BC between transition weft yarn $TE_1$ and weft yarn $E_1$ immediately adjacent to transition weft yarn $TE_1$ in the first orientation $OW_1$ of warp direction WA. A further pile extends out of backing fabric BF of bottom fabric BC between the two transition weft yarns $TE_1$, $TE_2$, and a third pile extends out of backing fabric BF of bottom fabric BC between transition weft yarn $TE_2$ and weft yarn $E_2$ immediately adjacent to transition weft yarn $TE_2$ in the second orientation $OW_2$ of warp direction WA.

Figure 4:
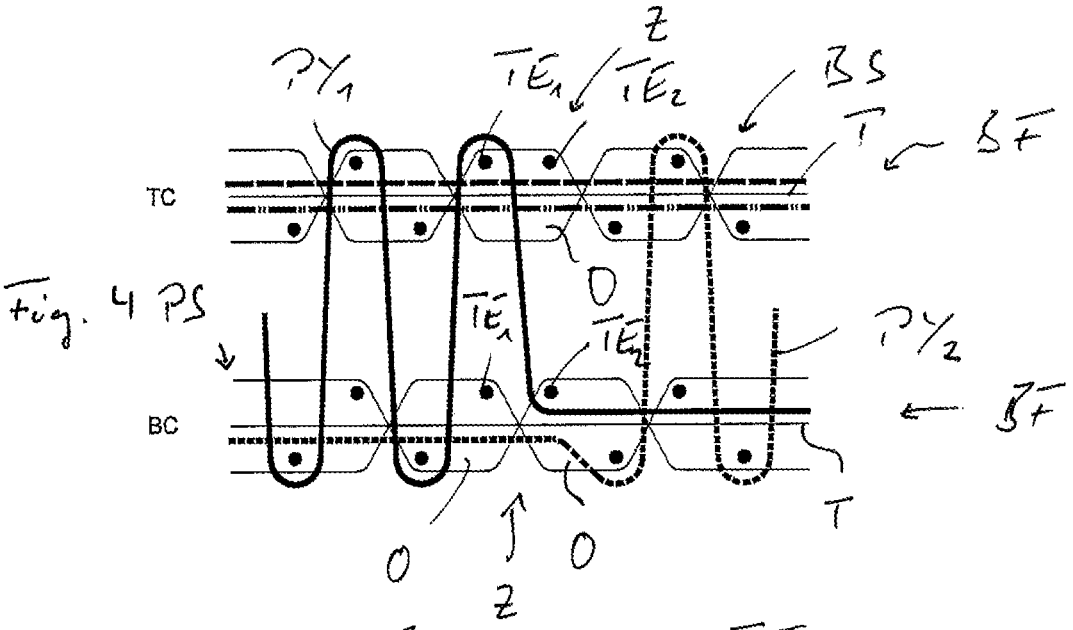
FIG. 4 shows a further alternative weaving structure of two fabrics in a face-to-face weaving process.

FIG. 4 shows a further alternative weaving structure providing a change of inclination accompanied by a change of the pile forming pile warp yarn, both pile warp yarns being bound into the same backing fabric BF when providing dead pile warp yarns.

In top fabric TC, pile warp yarn $PY_1$ used for forming piles on the left side of transition zones Z is interlaced with transition weft yarn $TE_1$ of transition zone Z for the last time such as to extend out of backing fabric BF of top fabric TC between the two transition weft yarns $TE_1$, $TE_2$. Pile warp yarn $PY_1$ further extends out of backing fabric BF of bottom fabric BC between the two transition weft yarns $TE_1$, $TE_2$ of transition zone Z of this fabric BC before being bound into backing fabric BF as a dead pile warp yarn on the right side of transition zones Z. Therefore, in both fabrics TC, BC, a pile P will extend out of the respective backing fabric BF between transition weft yarns $TE_1$ and the weft yarns immediately adjacent to transition weft yarns $TE_1$ in the first orientation $OW_1$ of warp direction WA and also between the two transition weft yarns $TE_1$, $TE_2$. In both fabrics TC, BC, no pile extends out of the respective backing fabric BF between the other transition weft yarn $TE_2$ and a weft yarn immediately adjacent to this transition weft yarn $TE_2$ in the second orientation $OW_2$ of warp direction WA.

A further difference of this embodiment of a weaving structure with respect to the embodiments shown in FIGS. 1 to 3 is that, in the weaving structure of FIG. 4, the two transition weft yarns $TE_1$, $TE_2$ provided in transition zone Z of top fabric TC such as to extend through the same weft receiving opening O are arranged on the back side BS relative to the weft separating warp yarns of top fabric TC, while transition weft yarns $TE_1$, $TE_2$ of transition zone Z of bottom fabric BC arranged in different weft receiving openings O are provided on the pile side PS relative to the weft separating warp yarns of bottom fabric BC.

Figure 5:
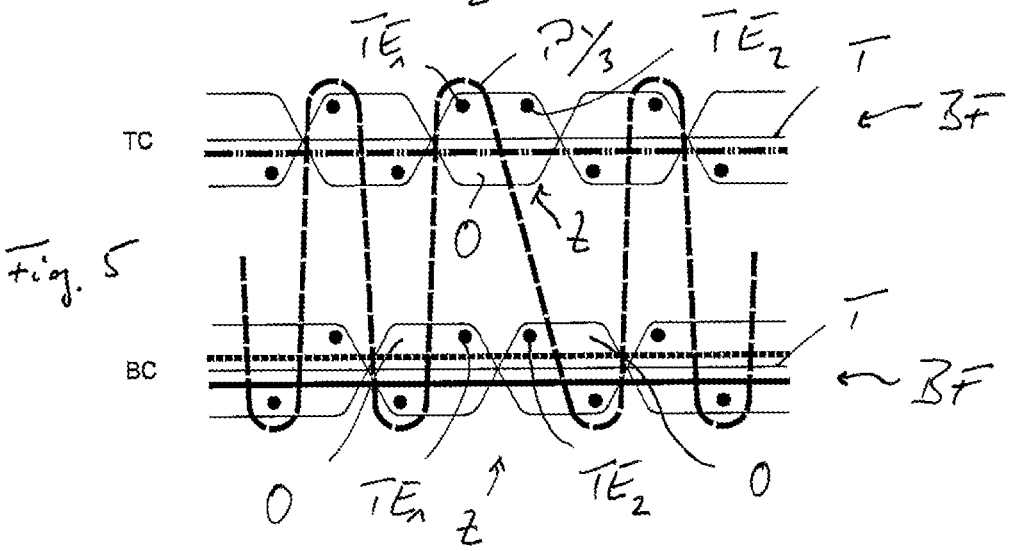
FIG. 5 shows a further alternative weaving structure of two fabrics in a face-to-face weaving process.

FIG. 5 shows a further alternative weaving structure in which, as is the case with the embodiment shown in FIG. 1, no change of the pile-forming pile warp yarn occurs when changing the direction of inclination of the piles.

In the weaving structure shown in FIG. 5, pile warp yarn $PY_3$ used for forming piles P on the left side of transition zones Z is interlaced with transition weft yarn $TE_1$ of transition zone Z of top fabric TC such as to provide a pile extending out of backing fabric BF of top fabric TC between the two transition weft yarns $TE_1$, $TE_2$ of this transition zone. None of the transition weft yarns $TE_1$, $TE_2$ of the transition zone Z provided in bottom fabric BC is used for interlacing with pile-forming pile warp yarn $PY_1$. Therefore, in bottom fabric BC, piles will extend out of backing fabric BF on both sides of transition zone Z, i.e. between each one of the transition weft yarns $TE_1$, $TE_2$ and weft yarns $E_1$, $E_2$ arranged immediately adjacent to these transition weft yarns $TE_1$, $TE_2$ in the first orientation $OW_1$ and the second orientation $OW_2$ of warp direction WA, respectively.

When comparing the weaving structures of FIGS. 1 and 5, it becomes clear that, while, in the weaving structure of FIG. 1, piles P provided on both sides of transition zones Z will be inclined towards these transition zones Z, in the weaving structure shown in FIG. 5, piles P provided on both sides of transition zones Z will be inclined away from transition zones Z.

Figure 6:
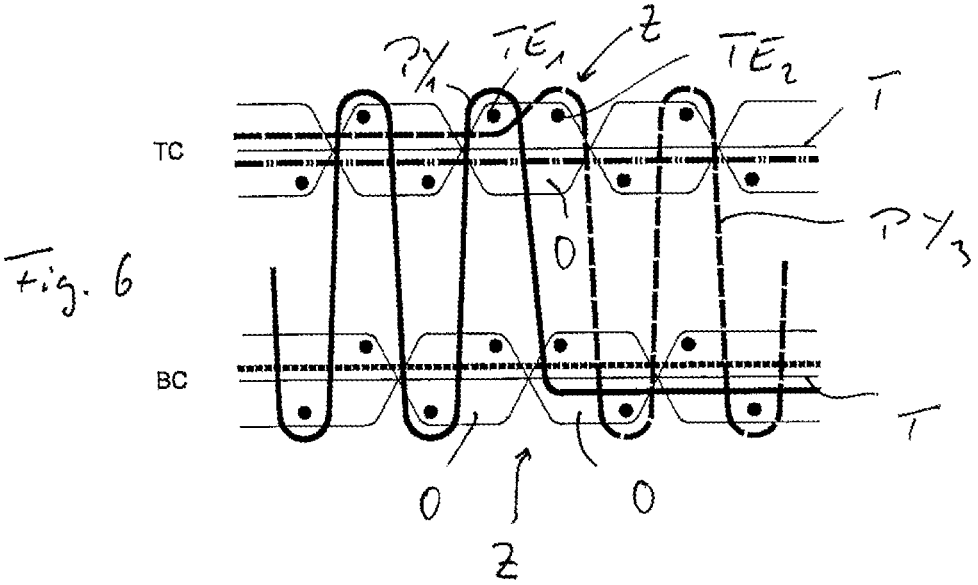
FIG. 6 shows a further alternative weaving structure of two fabrics in a face-to-face weaving process.
Figure 7:
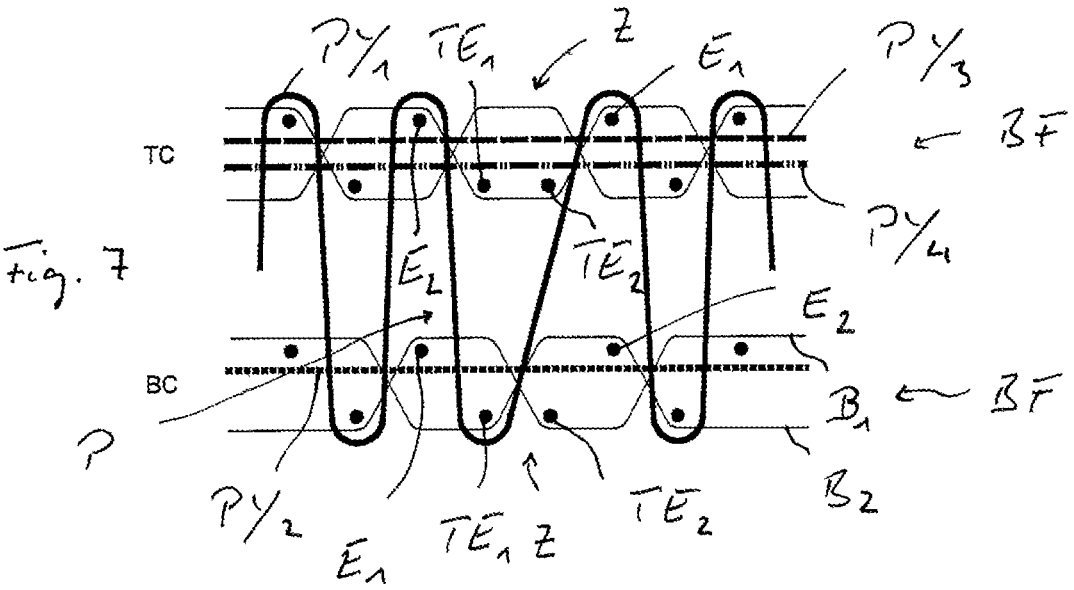
FIG. 7 shows a further alternative weaving structure of two fabrics in a face-to-face weaving process.
Figure 8:
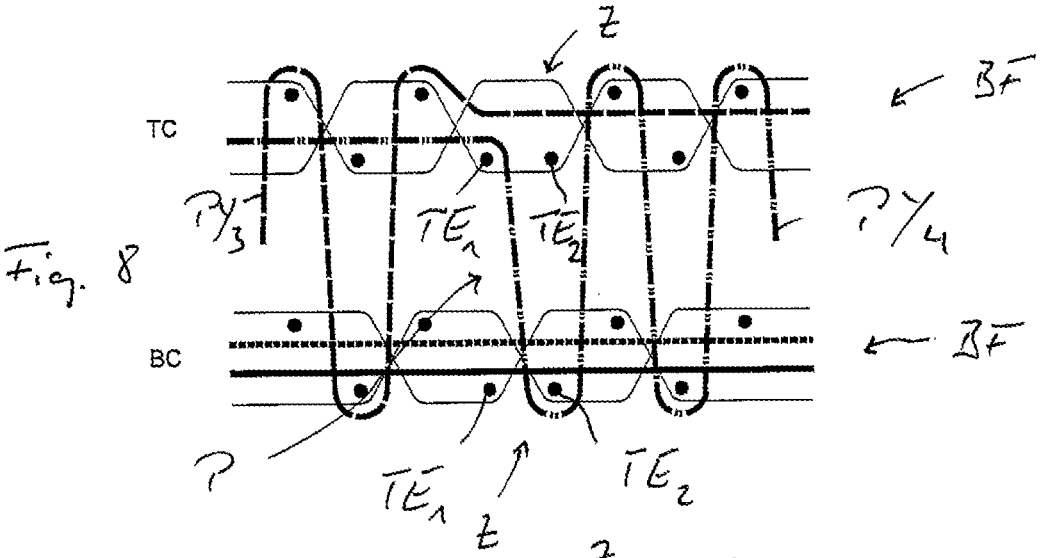
FIG. 8 shows a further alternative weaving structure of two fabrics in a face-to-face weaving process.
Figure 9:
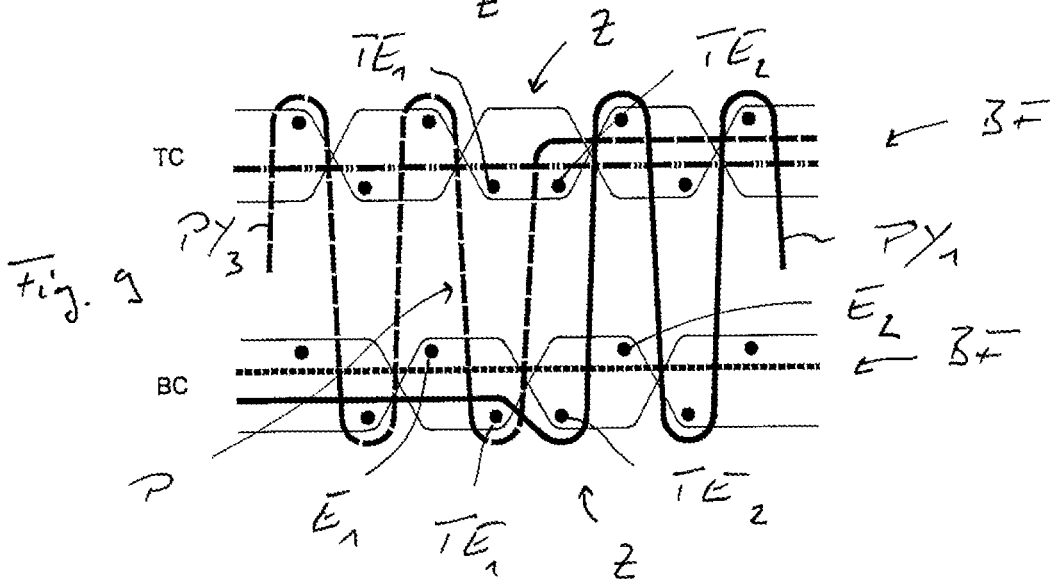
FIG. 9 shows a further alternative weaving structure of two fabrics in a face-to-face weaving process.
Figure 10:
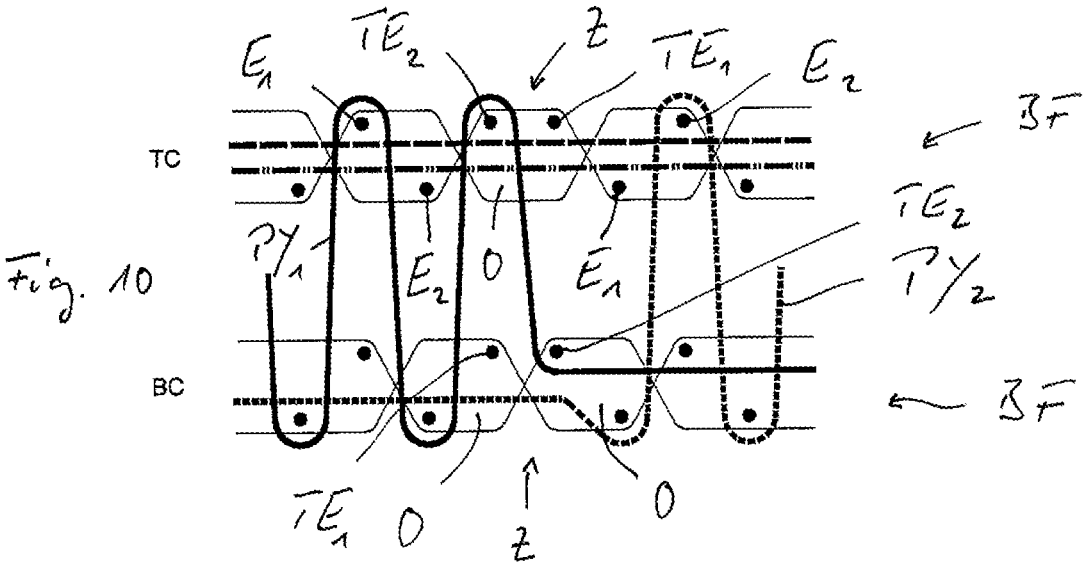
FIG. 10 shows a further alternative weaving structure of two fabrics in a face-to-face weaving process.
Figure 11:
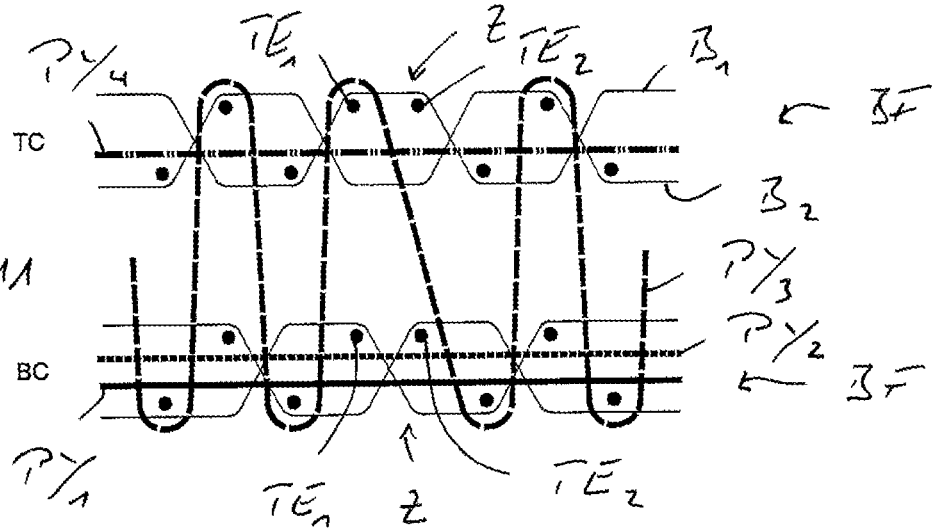
FIG. 11 shows a further alternative weaving structure of two fabrics in a face-to-face weaving process.
Figure 12:
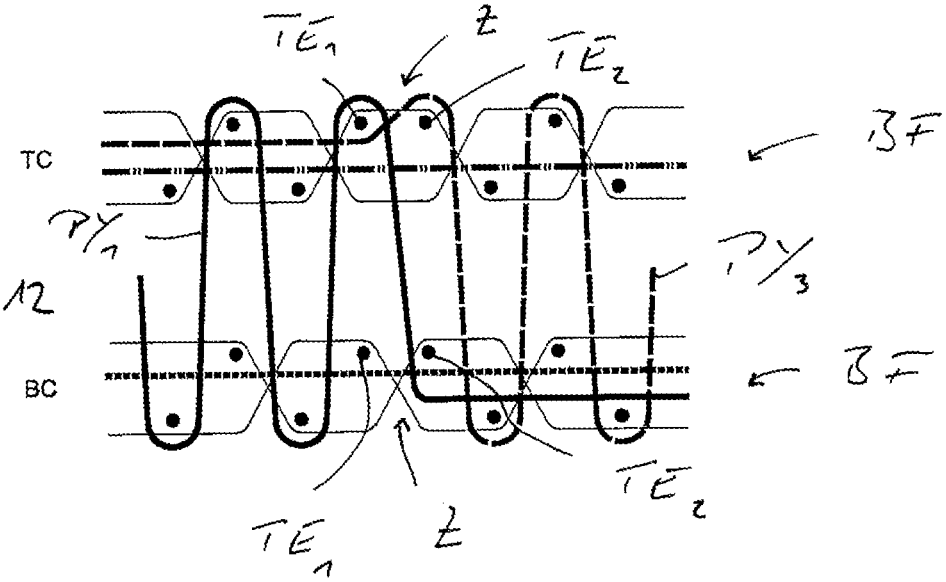
FIG. 12 shows a further alternative weaving structure of two fabrics in a face-to-face weaving process.

A further alternative weaving structure is shown in FIG. 6. The weaving structure of FIG. 6 is quite similar to the weaving structure of FIG. 3, showing a transition zone Z in which both transition weft yarns $TE_1$, $TE_2$ are used for interlacing with pile-forming pile warp yarns $PY_1$ and $PY_3$. Contrary to the embodiment shown in FIG. 3, these two transition weft yarns $TE_1$, $TE_2$ provided in the top fabric TC are arranged such as to extend through the same weft receiving opening O. This leads to a structure in which piles P provided by pile-forming pile warp yarns $PY_1$, $PY_3$ on both sides of transition zones Z are inclined away from transition zones Z, while, in the weaving structure of FIG. 3, piles P provided on both sides of transition zones Z, after cutting the pile-forming pile warp yarns, will be inclined towards transition zones Z.

In all the weaving structures shown in FIGS. 1 to 6, the backing fabrics BF of the two fabrics TC, BC comprise tension warp yarns T preferably in each one of the warp yarn systems used during a weaving process. In each one of these embodiments, at least tension warp threads T provided within backing fabrics BF are used as weft separating warp yarns for separating weft yarns $E_1$, $E_2$ extending through the respective weft receiving openings O in direction D perpendicular with respect to warp direction WA and the weft direction. Additionally to using these tension warp threads T as weft separating warp yarns, in most of the embodiments, pile warp yarns providing dead pile warp yarns bound into the respective backing fabrics are used for separating weft yarns $E_1$, $E_2$ extending through the respective weft receiving openings O.

Contrary to these embodiments, the embodiments shown in FIGS. 7 to 12 do not have such tension warp yarns in at least some of the warp yarn systems, preferably each one of the warp yarn systems. This means that, in all these embodiments shown in FIGS. 7 to 12, only the dead pile warp yarns bound into the respective backing fabrics BF are used for separating weft yarns $E_1$, $E_2$ extending through the respective weft-receiving openings O. Insofar as the transitions for providing a change of the inclination and, in some cases, for additionally changing the pile-forming pile warp yarn, are concerned, the embodiments shown in FIGS. 7 to 12 are identical to the ones as shown in FIGS. 1 to 6. In particular, the embodiment shown in FIG. 7 corresponds to the one shown in FIG. 1, the embodiment shown in FIG. 8 corresponds to the one shown in FIG. 2, the embodiment shown in FIG. 9 corresponds to the one shown in FIG. 3, the embodiment shown in FIG. 10 corresponds to the one shown in FIG. 4, the embodiment shown in FIG. 11 corresponds to the one shown in FIG. 5, and the embodiment shown in FIG. 12 corresponds to the one shown in FIG. 6. Therefore, with respect to the weaving structures of these embodiments, reference can be made to the above description of the embodiments shown in FIGS. 1 to 6.

The invention claimed is:

1. A fabric having a shadow effect, comprising a backing fabric having binding warp yarns repeatedly crossing each other for providing weft receiving openings between crossings thereof following each other in a warp direction and weft yarns substantially extending in a weft direction through the weft receiving openings, pile warp yarns interlaced with the weft yarns of the backing fabric for providing piles extending out of the backing fabric at a pile side, wherein, through at least one weft receiving opening two weft yarns extend, wherein in at least one weft receiving opening one of the weft yarns is positioned at a back side relative to at least one weft separating warp yarn extending in the backing fabric substantially in the warp direction and the other one of the weft yarns is positioned at the pile side relative to the at least one weft separating warp yarn, wherein for providing a pile in association with this weft receiving opening, a pile warp yarn is interlaced with the weft yarn of this weft receiving opening positioned at the back side relative to the at least one weft separating warp yarn, such as to extend out of the backing fabric between this weft yarn and the other weft yarn of this weft receiving opening, wherein, for changing the direction of inclination of the piles, at least one transition zone is provided, wherein, in at least one transition zone, two transition weft yarns provided immediately adjacent to each other in the warp direction extending through at least one weft receiving opening are positioned at substantially the same level in a direction that is substantially perpendicular with respect to a plane defined by the warp direction and the weft direction and/or are not separated by a weft separating warp yarn.

2. The fabric according to claim 1, wherein, in at least one transition zone, the two transition weft yarns are positioned at a back side relative to at least one weft separating warp yarn and/or wherein, in at least one transition zone, the two transition weft yarns are positioned at a pile side relative to at least one weft separating warp yarn.

3. The fabric according to claim 1, wherein, in at least one transition zone, the two transition weft yarns extend through the same weft receiving opening, and/or wherein, in at least one transition zone, the two transition weft yarns extend through different weft receiving openings.

4. The fabric according to claim 1, wherein, for changing the direction of inclination of the piles and changing the pile forming pile warp yarn, in at least one transition zone, a first one of the transition weft yarns is interlaced with a first pile-forming pile warp yarn and a second one of the transition weft yarns is interlaced with a second pile-forming pile warp yarn, such that a pile provided by the first pile-forming pile warp yarn extends out of the backing fabric at the pile side between the first one of the transition weft yarns and a weft yarn immediately adjacent to the first one of the transition weft yarns in a first orientation of the warp direction, and a pile provided by the second pile-forming pile warp yarn extends out of the backing fabric at the pile side-between the second one of the transition weft yarns and a weft yarn immediately adjacent to the second one of the transition weft yarns in a second orientation of the warp direction.

5. The fabric according to claim 1, wherein, for changing the direction of inclination of the piles and changing the pile forming pile warp yarn, in at least one transition zone, a pile-forming pile warp yarn is interlaced with one of the two transition weft yarns of this transition zone, such that a pile provided by the pile-forming pile warp yarn extends out of the backing fabric at the pile side between the two transition weft yarns of this transition zone and that no pile extends out of the backing fabric between the other one of the two transition weft yarns of this transition zone and a weft yarn immediately adjacent to this transition weft yarn or that no pile extends out of the backing fabric between the one of the two transition weft yarns of this transition zone and a weft yarn immediately adjacent to this transition weft yarn.

6. The fabric according to claim 1, wherein, for changing the inclination of the piles without changing the pile forming pile warp yarn, in at least one transition zone, the pile-forming pile warp yarn is interlaced with none of the two transition weft yarns of this transition zone, such that a first pile provided by the pile-forming pile warp yarn extends out of the backing fabric at the pile side between a first one of the transition weft yarns and a weft yarn immediately adjacent to the first one of the transition weft yarns of this transition zone in a first orientation of the warp direction, and a second pile provided by the pile-forming pile warp yarn extends out of the backing fabric at the pile side between a second one of the transition weft yarns of this transition zone and a weft yarn immediately adjacent to the second one of the transition weft yarns in a second orientation of the warp direction, and/or wherein, for changing the inclination of the piles without changing the pile forming pile warp yarn, in at least one transition zone, the pile-forming pile warp yarn is interlaced with one of the two transition weft yarns extending through a weft receiving opening of this transition zone, such as to extend out of the backing fabric at the pile side between the two transition weft yarns of this weft receiving opening.

7. The fabric according to claim 1, wherein, for changing the inclination of the piles without changing the pile forming pile warp yarn, in at least one transition zone, the pile-forming pile warp yarn, in a first weft receiving opening of this transition zone, is interlaced with a weft yarn separated from the transition weft yarn of this first weft receiving opening by at least one weft separating warp yarn, such that a first pile provided by this pile-forming pile warp yarn extends out of the backing fabric at the pile side between the transition weft yarn of this first weft receiving opening and the other weft yarn of this first weft receiving opening, and, in a second weft receiving opening of this transition zone, is interlaced with a weft yarn separated from the transition weft yarn of this second weft receiving opening by at least one weft separating warp yarn, such that a second pile provided by this pile-forming pile warp yarn extends out of the backing fabric at the pile side between the transition weft yarn of this second weft receiving opening and the other weft yarn of this second weft receiving opening.

8. The fabric according to claim 1, wherein no tension warp yarns are provided in the backing fabric.

9. The fabric according to claim 1, wherein, in association with at least one weft receiving opening, a pile is provided by interlacing a pile warp yarn with a weft yarn of this weft receiving opening positioned immediately adjacent to the crossing of the binding warp yarns defining this weft receiving opening in a first orientation of the warp direction and, in association with at least one other weft receiving opening, a pile is provided by interlacing a pile warp yarn with a weft yarn of this weft receiving opening positioned immediately adjacent to the crossing of the binding warp yarns defining this weft receiving opening in a second orientation of the warp direction.

10. The fabric according to claim 1, wherein pile warp yarns not used for forming piles are bound into the backing fabric such as to extend substantially in the warp direction as dead pile warp yarns, and wherein the weft yarns of at least one weft receiving opening are separated from one another by at least one, preferably all the dead pile warp yarns extending in the area of this weft receiving opening as weft separating warp yarns.

11. The fabric according to claim 1, wherein a plurality of warp yarn systems is provided following each other in the weft direction, at least one warp yarn system comprising two binding warp yarns crossing each other and at least one pile warp yarn, wherein in the pile warp yarn systems piles are provided by the pile warp yarns of a respective pile warp yarn system by interlacing these pile warp yarns with weft yarns extending through the weft receiving openings provided by the binding warp yarns of the same pile warp yarn system, such that, by means of the pile warp yarns of each one of the warp yarn systems, one row of piles substantially extending in the warp direction is provided.

12. A method of weaving a fabric having a shadow effect, comprising providing a backing fabric wherein:

binding warp yarns are provided repeatedly crossing each other for providing weft receiving openings between crossings thereof following each other in a warp direction, and weft yarns are provided such as to extend through the weft receiving openings substantially in a weft direction, and providing piles extending out of the backing fabric at a pile side, pile warp yarns are interlaced with weft yarns of the backing fabric, wherein the weft yarns are provided such that, through at least one weft receiving opening two weft yarns extend, wherein in at least one weft receiving opening one of the weft yarns is positioned at a back side relative to at least one weft separating warp yarn extending in the backing fabric substantially in the warp direction and the other one of the weft yarns is positioned at the pile side relative to the at least one weft separating warp yarn, and providing a pile in association with this weft receiving opening, a pile warp yarn is interlaced with the weft yarn of this weft receiving opening positioned at the back side relative to the at least one weft separating warp yarn, such as to extend out of the backing fabric between this weft yarn and the other weft yarn of this weft receiving opening, and changing the direction of inclination of the piles, wherein at least one transition zone is provided, wherein, in at least one transition zone, two transition weft yarns provided immediately adjacent to each other in the warp direction extending through at least one weft receiving opening are provided such as to be positioned at substantially the same level in a direction that is substantially perpendicular with respect to a plane defined by the warp direction and the weft direction and/or are provided such as not to be separated by a weft separating warp yarn.

13. The method according to claim 12, wherein, in at least one transition zone, the two transition weft yarns are positioned at a back side relative to at least one weft separating warp yarn, and/or wherein, in at least one transition zone, the two transition weft yarns are positioned at a pile side relative to at least one weft separating warp yarn.

14. The method according to claim 12, wherein, in at least one transition zone, the two transition weft yarns are provided such as to extend through the same weft receiving opening, and/or wherein, in at least one transition zone, the two transition weft yarns are provided such as to extend through different weft receiving openings.

15. The method according to claim 12, wherein, for changing the direction of inclination of the piles and changing the pile forming pile warp yarn, in at least one transition zone, a first one of the transition weft yarns is interlaced with a first pile-forming pile warp yarn and a second one of the transition weft yarns is interlaced with a second pile-forming pile warp yarn, such that a pile provided by the first pile-forming pile warp yarn extends out of the backing fabric at the pile side between the first one of the transition weft yarns and a weft yarn immediately adjacent to the first one of the transition weft yarns in a first orientation of the warp direction, and a pile provided by the second pile-forming pile warp yarn extends out of the backing fabric at the pile side between the second one of the transition weft yarns and a weft yarn immediately adjacent to the second one of the transition weft yarns in a second orientation of the warp direction.

16. The method according to claim 12, wherein, for changing the direction of inclination of the piles and changing the pile forming pile warp yarn, in at least one transition zone, a pile-forming pile warp yarn is interlaced with one of the two transition weft yarns of this transition zone, such that a pile provided by the pile-forming pile warp yarn extends out of the backing fabric at the pile side between the two transition weft yarns of this transition zone and that no pile extends out of the backing fabric between the other one of the two transition weft yarns of this transition zone and a weft yarn immediately adjacent to this transition weft yarn or that no pile extends out of the backing fabric between the one of the two transition weft yarns of this transition zone and a weft yarn immediately adjacent to this transition weft yarn.

17. The method according to claim 12, wherein, for changing the inclination of the piles without changing the pile forming pile warp yarn, in at least one transition zone, the pile-forming pile warp yarn is interlaced with none of the two transition weft yarns of this transition zone, such that a first pile provided by the pile-forming pile warp yarn extends out of the backing fabric at the pile side between a first one of the transition weft yarns and a weft yarn immediately adjacent to the first one of the transition weft yarns of this transition zone in a first orientation of the warp direction, and a second pile provided by the pile-forming pile warp yarn extends out of the backing fabric at the pile side between a second one of the transition weft yarns of this transition zone and a weft yarn immediately adjacent to the second one of the transition weft yarns in a second orientation of the warp direction, and/or wherein, for changing the inclination of the piles without changing the pile forming pile warp yarn, in at least one transition zone, the pile-forming pile warp yarn is interlaced with one of the two transition weft yarns extending through a weft receiving opening of this transition zone, such as to extend out of the backing fabric at the pile side between the two transition weft yarns of this weft receiving opening.

18. The method according to claim 12, wherein, for changing the inclination of the piles without changing the pile forming pile warp yarn, in at least one transition zone, the pile-forming pile warp yarn, in a first weft receiving opening of this transition zone, is provided such as to be interlaced with a weft yarn separated from the transition weft yarn of this first weft receiving opening by at least one weft separating warp yarn, such that a first pile provided by this pile-forming pile warp yarn extends out of the backing fabric at the pile side between the transition weft yarn of this first weft receiving opening and the other weft yarn of this first weft receiving opening, and, in a second weft receiving opening of this transition zone, is provided such as to be interlaced with a weft yarn separated from the transition weft yarn of this second weft receiving opening by at least one weft separating warp yarn, such that a second pile provided by this pile-forming pile warp yarn extends out of the backing fabric at the pile side between the transition weft yarn of this second weft receiving opening and the other weft yarn of this second weft receiving opening.

19. The method according to claim 12, wherein, in association with each fabric to be woven, a plurality of warp yarn systems are provided following each other in the weft direction, at least one warp yarn system comprising two binding warp yarns crossing each other and at least one, wherein, in the pile warp yarn systems, piles are provided by the pile warp yarns of a respective pile warp yarn system by interlacing these pile warp yarns with weft yarns extending through the weft receiving openings provided by the binding warp yarns of the same pile warp yarn system, such that, by means of the pile warp yarns of each one of the warp yarn systems, one row of piles substantially extending in the warp direction is provided, wherein, in association with at least one reed dent of a weaving machine, at least one warp yarn system is provided, and/or wherein, in association with at least one warp yarn system no tension warp yarns are provided.

20. The method according to claim 12, wherein the method is a face-to-face weaving method for simultaneously weaving two fabrics, wherein at least one warp yarn system comprises the warp yarns for both fabrics to be woven.

21. The method according to claim 19, wherein, in association with at least one warp yarn system, the crossings of the binding warp yarns of one of the two fabrics to be woven are offset relative to the crossings of the binding warp yarns of the other one of the fabrics to be woven in the warp direction.

22. The method according to claim 12, wherein, in at least one fabric, the crossings of the binding warp yarns defining the weft receiving openings in the two orientations of the warp direction are located at the same position in the warp direction.

* * * * *